US008535459B2

(12) United States Patent
Miyanishi et al.

(10) Patent No.: US 8,535,459 B2
(45) Date of Patent: Sep. 17, 2013

(54) STEEL MATERIAL FOR HARDENING

(75) Inventors: Kei Miyanishi, Tokyo (JP); Manabu Kubota, Tokyo (JP); Shuji Kozawa, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/520,633

(22) PCT Filed: May 17, 2011

(86) PCT No.: PCT/JP2011/061342

§ 371 (c)(1),
(2), (4) Date: Jul. 5, 2012

(87) PCT Pub. No.: WO2011/152206

PCT Pub. Date: Dec. 8, 2011

(65) Prior Publication Data

US 2012/0279616 A1 Nov. 8, 2012

(30) Foreign Application Priority Data

May 31, 2010 (JP) ..... 2010-124536

(51) Int. Cl.

| | |
|---|---|
| ***C22C 38/60*** | (2006.01) |
| ***C22C 38/14*** | (2006.01) |
| ***C22C 38/06*** | (2006.01) |
| ***C22C 38/28*** | (2006.01) |
| ***C22C 38/50*** | (2006.01) |

(52) U.S. Cl.
USPC ..... 148/328; 148/331; 148/332; 148/334; 148/335; 148/336; 420/84; 420/126; 420/128

(58) Field of Classification Search
USPC ..... 148/328, 331–336; 420/84–93, 420/103–116, 119–120, 122–129
See application file for complete search history.

(56) References Cited

FOREIGN PATENT DOCUMENTS

| | | |
|---|---|---|
| CN | 1616850 | 5/2005 |
| CN | 1802446 | 7/2006 |
| JP | 10-121193 | 5/1998 |
| JP | 2002-146473 | 5/2002 |
| JP | 2002-309342 | 10/2002 |
| JP | 2003-321713 | 11/2003 |
| JP | 3706560 | 10/2005 |
| JP | 3738501 | 1/2006 |
| JP | 4193998 | 12/2008 |
| JP | 2009-007643 | 1/2009 |
| JP | 2009-030160 | 2/2009 |
| JP | 2009-108340 | 5/2009 |
| JP | 2009-256695 | 11/2009 |
| WO | 2008/084749 | 7/2008 |

OTHER PUBLICATIONS

Chinese Office Action dated Feb. 26, 2013, issued in corresponding Chinese Application No. 201180007518.2, and an English translation of the Search Report only.
International Search Report dated Aug. 30, 2011, issued in corresponding PCT Application No. PCT/JP2011/061342.
Japanese Office Action dated Mar. 13, 2012, issued in corresponding Japanese application No. 2011-552101, with an English translation thereof.
Shigeo, Nikkan Kogyo Shimbun, "Yakiiresei (Hardening of steels)—Motomekata to katsuyou (How to obtain and its use)—", OWAKU, Sep. 25, 1979, with a partial English translation thereof.

*Primary Examiner* — Deborah Yee
(74) *Attorney, Agent, or Firm* — Kenyon & Kenyon LLP

(57) ABSTRACT

The present invention provides a steel material for hardening, including chemical components, by mass %, of: C: 0.15 to 0.60%; Si: 0.01 to 1.5%; Mn: 0.05 to 2.5%; P: 0.005 to 0.20%; S: 0.001 to 0.35%; Al: over 0.06 to 0.3%; and total N: 0.006 to 0.03%, with a balance including Fe and inevitable impurities including B of not more than 0.0004%, in which a hardness R at a position 5 mm away from a quenching end measured through a Jominy-type end-quenching method specified in JIS G 0561, and a calculation hardness H at a position 4.763 mm away from the quenching end satisfy the following Equation (1).

$$H \times 0.948 \leq R \leq H \times 1.05 \quad \text{Equation (1)}$$

5 Claims, No Drawings

STEEL MATERIAL FOR HARDENING

TECHNICAL FIELD

The present invention relates to a steel material for hardening having excellent machinability and hardening stability, and a method for producing the steel material.

This application is a national stage application of International Application No. PCT/JP2011/061342, filed May 17, 2011, which claims priority to Japanese Patent Application No. 2010-124536 filed in Japan on May 31, 2010, the contents of which are incorporated herein by reference.

BACKGROUND ART

In recent years, steels have become increasingly stronger, but this causes a problem of deterioration in workability. Thus, there is a strong demand for steels having improved machinability while maintaining the strength. Conventionally, in order to improve the machinability of the steel, elements such as S, Pb, and Bi have been added for improving the machinability. Pb and Bi improve the machinability and have a relatively small effect on the forging, but deteriorate properties related to strength such as impact properties.

Further, the element S forms a soft inclusion such as MnS under cutting environments, thereby improving the machinability. However, MnS has a size larger than Pb or other particles, and hence, is likely to form a source of stress concentration. In particular, when MnS is stretched through forging or rolling, this causes anisotropy in impact properties and the like, and mechanical properties become significantly weak in a specific direction. This anisotropy of mechanical properties has to be taken into consideration in the case of designing a steel structure. Thus, it is necessary to employ a technique for reducing the anisotropy in the mechanical properties in the case when S is added to the steel.

As described above, even if elements effective in improving the machinability are added, the impact properties deteriorate, and hence, it is difficult to achieve both the strength and the machinability at the same time. Further, in recent years, from the viewpoint of environmental protection, there is a tendency to avoid using Pb. Thus, further technical innovations are required to achieve both the machinability and the strength of the steel.

Conventionally, there are several technical proposals for improving the machinability without deteriorating the strength. Patent Document 1 proposes a steel for a machine structure including: C: 0.05 to 1.2% (mass %, the same applies to the following elements); Si: 0.03 to 2%; Mn: 0.2 to 1.8%; P: 0.03% or lower (not including 0%); S: 0.03% or lower (not including 0%); Cr: 0.1 to 3%; Al: 0.06 to 0.5%; N: 0.004 to 0.025%; and O: 0.003% or lower (not including 0%), the steel further including Ca: 0.0005 to 0.02% and/or Mg: 0.0001 to 0.005%, and the steel including solute N: 0.002% or more, with a balance including iron and inevitable impurities, and the steel satisfying the following relationship of Expression (A).

$$(0.1\times[Cr]+[Al])/[O]\geqq 150 \qquad \text{Expression (A)}$$

where [Cr], [Al] and [O] represent amounts (mass %) of Cr, Al and O, respectively.

Patent Document 2 proposes a steel for a machine structure, the steel including: C: 0.01 to 0.7%; Si: 0.01 to 2.5%; Mn: 0.1 to 3%; S: 0.01 to 0.16%; and Mg: 0.02% or lower (not including 0%), the steel satisfying $[Mg]/[S]\leqq 7.7\times10^{-3}$, in which, of sulfide-based inclusions observed in the steel, an average value of an aspect ratio of the sulfide-based inclusion having a long span of 5 μm or more is 5.2 or lower, and an average value of an aspect ratio of the sulfide-based inclusion having a long span of 50 μm or more is 10.8 or lower, and in which the steel satisfies $a/b\leqq 0.25$, where a reference character a represents the number of sulfide-based inclusions having a long span of 20 μm or more, and a reference character b represents the number of sulfide-based inclusions having a long span of 5 μm or more.

Patent Document 3 proposes a steel for carburizing, the steel including: C: 0.12 to 0.22%; Si: 0.40 to 1.50%; Mn: 0.25 to 0.45%; Ni: 0.50 to 1.50%; Cr: 1.30 to 2.30%; B: 0.0010 to 0.0030%; Ti: 0.02 to 0.06%; Nb: 0.02 to 0.12%; and Al: 0.005 to 0.050%, with a balance substantially consisting of iron, in which a distance from a quenching end to a position having a hardness corresponding to 50% martensite in an end quenching test is 20 mm or more, and a component parameter H(H=106C(%)+10.8Si(%)+19.9Mn(%)+16.7Ni(%)+8.55Cr(%)+45.5Mo(%)+28) is 95 or less.

RELATED ART DOCUMENTS

Patent Documents

Patent Document 1: Japanese Examined Patent Application, Second Publication No. 4193998

Patent Document 2: Japanese Examined Patent Application, Second Publication No. 3706560

Patent Document 3: Japanese Unexamined Patent Application, First Publication No. 2002-309342

Non-Patent Document

Non-patent Document 1: "*Yakiiresei* (Hardening of steels)—*Motomekata to katsuyou* (How to obtain and its use)—," (author: OWAKU Shigeo, publisher: Nikkan Kogyo Shimbun, publishing date: Sep. 25, 1979)

DISCLOSURE OF THE INVENTION

Problems to be Solved by the Invention

The techniques proposed by Patent Documents 1 to 3 have the following problems, and cannot sufficiently meet the demand to improve the machinability without deteriorating the strength.

The steel proposed by Patent Document 1 improves the lifetime of cutting tools. However, it contains a relatively large amount of Al, which is an element generating nitride, of 0.06% to 0.5%, and hence, N is fixed with Al to be AlN. This makes B added by 0.005% or lower become a solute state, improving the hardenability according to the amount of B. However, the solute B significantly achieves the effect of improving the hardenability even if the amount of B is small. Thus, it is difficult to suppress the variation in the hardenability (in other words, to achieve stable hardening).

With the steel proposed by Patent Document 2, the lifetime of the cutting tool is not taken into consideration, and hence, there is no mention of characteristics for avoiding the reduction in the lifetime of the cutting tool.

The steel proposed by Patent Document 3 can achieve both the high hardenability and the low material hardness, and hence, it can be considered that the machinability can be improved without deteriorating the strength after carburizing. However, the steel contains B of 0.0010% to 0.0030%. This makes the solute B, which originally improves the hardenability, become BN due to N entering from the surface layer at the time of gas carburizing. Thus, this steel cannot solve the problem that the hardenability does not improve in the carburizing surface layer, and the imperfect hardened structure increases, thereby reducing the strength.

In other words, with the steel proposed by Patent Document 3, the desired hardenability cannot be achieved, and the hardenability varies depending on the amount of N entering from the surface layer, so that the desired hardenability cannot be obtained in a stable manner.

As described above, the conventional techniques cannot sufficiently meet the currently demanded strength, in other words, cannot solve the problem of improving the machinability while stably maintaining the hardenability (hardening stability).

In view of the circumstances described above, the present invention aims to solve the problems and provide a steel material for hardening exhibiting excellent machinability while maintaining the hardenability in a stable manner.

Means for Solving the Problems

The present invention employs the following means for solving the problems described above.

(1) A first aspect of the present invention provides a steel material for hardening, including chemical components, by mass %, of: C: 0.15 to 0.60%; Si: 0.01 to 1.5%; Mn: 0.05 to 2.5%; P: 0.005 to 0.20%; S: 0.001 to 0.35%; Al: over 0.06 to 0.3%; and total N: 0.006 to 0.03%, with a balance including Fe and inevitable impurities including B of not more than 0.0004%, in which R and H satisfy $H \times 0.948 \leqq R \leqq H \times 1.05$, where the R is a hardness at a position 5 mm away from a quenching end measured through a Jominy-type end-quenching method specified in JIS G 0561, and the H is a calculation hardness at a position 4.763 mm away from the quenching end.

(2) The steel material for hardening according to (1) above may contain the chemical components further including, in mass %, one or more of: Cr: 0.1 to 3.0%; Mo: 0.01 to 1.5%; Cu: 0.1 to 2.0%; Ni: 0.1 to 5.0%; Ca: 0.0002 to 0.005%; Zr: 0.0003 to 0.005%; Mg: 0.0003 to 0.005%; REM: 0.0001 to 0.015%; Nb: 0.01 to 0.1%; V: 0.03 to 1.0%; W: 0.01 to 1.0%; Sb: 0.0005 to 0.0150%; Sn: 0.005 to 2.0%; Zn: 0.0005 to 0.5%; Te: 0.0003 to 0.2%; Bi: 0.005 to 0.5%; and Pb: 0.005 to 0.5%.

(3) The steel material for hardening according to (1) above may contain the chemical components further including, in mass %, Ti: 0.001 to 0.05%, in which [total N] and [Ti] may satisfy $0.006+[Ti]\times(14/48) \leqq [\text{total N}] \leqq 0.03$, where [total N] is the total amount (%) of N, and [Ti] is the amount (%) of Ti.

(4) The steel material for hardening according to (3) above may contain the chemical components further including, in mass %, one or more of: Cr: 0.1 to 3.0%; Mo: 0.01 to 1.5%; Cu: 0.1 to 2.0%; Ni: 0.1 to 5.0%; Ca: 0.0002 to 0.005%; Zr: 0.0003 to 0.005%; Mg: 0.0003 to 0.005%; REM: 0.0001 to 0.015%; Nb: 0.01 to 0.1%; V: 0.03 to 1.0%; W: 0.01 to 1.0%; Sb: 0.0005 to 0.0150%; Sn: 0.005 to 2.0%; Zn: 0.0005 to 0.5%; Te: 0.0003 to 0.2%; Bi: 0.005 to 0.5%; and Pb: 0.005 to 0.5%.

(5) A second aspect of the present invention provides a method for producing a steel material for hardening, in which a steel piece having the chemical components according to any one of (1) to (4) above is subjected to a heat treatment in which heating at a temperature of not less than 1260° C. is applied for not less than 20 minutes.

(6) A third aspect of the present invention provides a method for producing a steel material for hardening, in which a steel piece having the chemical components according to (3) or (4) above is subjected to a heat treatment in which heating at a temperature of not less than 1200° C. is applied for not less than 20 minutes in the case where the amount of Ti is not less than 0.019%, and heating at a temperature of not less than 1150° C. is applied for not less than 20 minutes in the case where the amount of Ti is not less than 0.025%.

(7) A fourth aspect of the present invention provides a power-transmitting part obtained by subjecting the steel material for hardening according to any one of (1) to (4) above to a machine work and hardening.

Effects of the Invention

According to the present invention, the effect of improving the machinability prolongs the tool life, thereby reducing the production cost. Further, the stable hardenability is achieved, thereby suppressing the variations in the deformation caused by the heat treatment.

EMBODIMENTS OF THE INVENTION

In order to solve the problems described above, the present inventors earnestly studied a relationship between the hardenability and the machinability of a steel material for hardening in the case of changing chemical components and thermal history of the steel material for hardening in an extensive and systematic manner. As a result, the present inventors reached the following findings (A) to (C). Hereinbelow, the unit "%" indicating the amount of component means "mass %" unless otherwise specified.

(A) If Al exceeds 0.06%, Al exists in the steel as solute Al, thereby improving the machinability of the steel material for hardening. In particular, by cutting the steel material for hardening using a tool coated with a coating containing oxide formed of metal elements having an affinity with oxygen less than or equal to Al, in other words, oxide having an absolute value of standard free energy of formation less than or equal to a value of $Al_2O_3$, the chemical reaction is more likely to occur at a surface of the tool that is brought into contact with the steel material for hardening. As a result, $Al_2O_3$ coating functioning as a tool-protection coating is easily generated on the surface of the tool, thereby prolonging the lifetime of the tool.

(B) If Al exceeds 0.06%, N is fixed as nitride (AlN). This makes B become a solute state, and the solute B makes the hardenability unstable.

(C) If Al exceeds 0.06%, the following conditions (a) to (c) need to be satisfied in order to prevent the B having the inevitable impurity volume from affecting the hardenability.

(a) B in the inevitable impurities is limited to 0.0004 mass % or lower.

(b) When the total amount (mass %) of N is denoted by [total N] and the amount (mass %) of Ti is denoted by [Ti], the [total N] and the [Ti] satisfy the following Equation (1).

$$0.006+[Ti]\times(14/48) \leqq [\text{total N}] \leqq 0.03 \quad \text{Equation (1)}$$

(c) Before the thermal treatment for hardening, a piece of the steel is heated to the high temperature of 1260° C. (or 1200° C. or 1150° C. depending on the increase in the Ti amount) or more, and this high temperature is maintained for at least 20 minutes.

Next, a description will be made of a mode for carrying out the present invention made on the basis of the findings described above.

First, chemical components of the steel material for hardening according to an embodiment of the present invention will be described.

C: 0.15 to 0.60%

C is an element largely affecting the strength of the steel. In the case where C is less than 0.15%, sufficient strength cannot be obtained, and it is necessary to add a large amount of other alloying elements. On the other hand, in the case where C exceeds 0.60%, the hardness increases, and the machinability significantly deteriorates. In order to obtain sufficient strength and desired machinability, the amount of C is set to be in the range of 0.15% to 0.60%. The lower limit of C is set preferably to be 0.30%. The upper limit of C is set preferably to be 0.50%.

Si: 0.01 to 1.5%

Si is an effective element in deoxidizing the steel, and an effective element in improving the strength of the ferrite and resistance to temper softening. In the case where Si is less than 0.01%, the effect obtained from the additive is not sufficient, and in the case where Si exceeds 1.5%, the steel becomes embrittled and the machinability significantly deteriorates. Further, carburizing properties are inhibited. Thus, the amount of Si is set to be in the range of 0.01% to 1.5%. The lower limit of Si is set preferably to be 0.03%. The upper limit of Si is set preferably to be 1.2%.

Mn: 0.05 to 2.5%

Mn is an element that fixes and disperses S in the steel as MnS, and is in solid solution in a matrix manner, thereby contributing to improvement in hardenability and securing the strength after hardening. In the case where Mn is less than 0.05%, S in the steel bonds to Fe to form FeS, and the steel becomes embrittled. On the other hand, in the case where Mn exceeds 2.5%, the hardness of the base material increases and the cold workability deteriorates. Further, the effect on the strength and the hardenability becomes saturated. Thus, the amount of Mn is set to be in the range of 0.05% to 2.5%. The lower limit of Mn is set preferably to be 0.10%. The upper limit of Mn is set preferably to be 2.2%.

P: 0.005 to 0.20%

P is an element to make the machinability favorable. In the case where P is less than 0.005%, the effect of the additive cannot be obtained. On the other hand, in the case where P exceeds 0.20%, the hardness of the base material increases, and the cold workability, hot workability and the casting property deteriorate. Thus, the amount of P is set to be in the range of 0.005% to 0.20%. The lower limit of P is set preferably to be 0.010%. The upper limit of P is set preferably to be 0.15%.

S: 0.001 to 0.35%

S forms MnS in the steel, and is an element contributing to improvement in the machinability. In the case where S is less than 0.001%, the effect obtained from the additive is not sufficient. On the other hand, in the case where S exceeds 0.35%, the effect obtained from the additive saturates. Further, the excess amount of S causes grain boundary segregation, leading to grain boundary embrittlement. Thus, the amount of S is set to be in the range of 0.001% to 0.35%. The lower limit of S is set preferably to be 0.01%. The upper limit of S is set preferably to be 0.1%.

Al: over 0.06% to 0.3%

Al is added for the purpose of deoxidizing the steel. If Al exceeds 0.06% in a state where N is 0.008% or lower, the solute Al is formed in the steel, which contributes to improvement in the machinability. However, in the case where Al exceeds 0.3%, the diameter of the grain of the inclusion $Al_2O_3$ becomes larger, and the fatigue strength deteriorates in the high cycle range. Thus, the amount of Al is set to be over 0.06% to 0.3%. The lower limit of Al is set preferably to be 0.08%. The upper limit of Al is set preferably to be 0.15%.

Total N (Ti=0%): 0.006 to 0.03%

Total N (Ti>0%): 0.006+[Ti]×(14/48) to 0.03%

N bonds to Al, Ti, Nb and/or V in the steel to form nitride or carbonitride, and suppresses the coarsening of the crystal grain. Further, N bonds to B contained as an impurity to form BN, which reduces the amount of B (which causes variation in the hardenability) segregated in the austenite grain boundary.

In the case where the total N is less than 0.006% and Ti is not added in the steel, the effect obtained from the additive does not sufficiently appear. Similarly, in the case where the total N is less than "0.006+[Ti]×(14/48)" ([Ti]: mass % of Ti) and Ti described later is added, the effect obtained from the additive does not sufficiently appear.

On the other hand, in the case where the total N exceeds 0.03%, the effect obtained from the additive saturates. Further, the carbonitride in non-solid-solution form remains at the time of heating in the hot rolling or hot forging, which makes it difficult to increase the fine carbonitride effective in suppressing the coarsening of the crystal grain.

Thus, the amount of the total N is set to be in the range of 0.0060 to 0.03% in the case where Ti is not added, and is set to be in the range of "0.006+[Ti]×(14/48)" to 0.03% in the case where Ti is added. The lower limit of the total N is set preferably to be 0.0080%. The upper limit of the total N is set preferably to be 0.010%.

It should be noted that, in the case where Ti is added, the amount of the total N % ([total N]) is set to be 0.006+[Ti]×(14/48) or more.

In the steel material for hardening according to this embodiment, B in the steel is segregated around BN or precipitates (TiN, TiCN, MnS and the like) at the time of hardening to reduce the amount of B segregated in the austenite grain boundary contributing to improvement in the hardenability, thereby suppressing the increase in the hardenability resulting from B. The larger amount of [total N] renders the precipitation of BN easier, and hence, a predetermined amount of [total N] is necessary. However, in the case where Ti exists in the steel, TiN stably exists to the high temperature range. Thus, the required amount of [total N] is an amount obtained by adding, to 0.06%, the amount of N: "[Ti]× atomic weight (14/48)," which is obtained by subtracting the amount of N in TiN. Thus, in the case where Ti is added, the lower limit of the total N % ([total N]) is set to be 0.006+[Ti]×(14/48).

B: over 0% to 0.0004%

B is segregated in the austenite grain boundary, improving the hardenability of the steel in an unstable manner. In the steel material for hardening according to this embodiment, B contained as the inevitable impurity is limited to 0.0004% or lower. B is an element inevitably contained from the raw material of iron even if not added intentionally. Thus, the lower limit is set to be over 0%. However, the lower limit value may be set to be 0.0001% because high cost is required to stably control the amount of B to be 0.0001% or lower.

In the case where the amount of Al is the general deoxidization agent level, even if B exists as the inevitable impurity, the effect of B on the hardenability is so small that it is negligible. However, in the case where Al in the steel exceeds 0.06%, N is fixed as nitride, the inevitable impurity B becomes the solid-solution state, and the solute B is segregated in the austenite grain boundary at the time of hardening. This leads to the significant deterioration in the hardening stability.

In the steel material for hardening according to this embodiment, B in the steel is segregated around BN or precipitations (TiN, TiCN, MnS and the like) at the time of hardening. This reduces the amount of B segregated in the austenite grain boundary contributing to improvement in the hardenability, thereby eliminating the effect of B on the hardenability. However, in the case where B exceeds 0.0004%, the amount of B segregated in the austenite grain boundary cannot be sufficiently reduced. Thus, the upper limit of B is set to be 0.0004%.

Further, Ti may be added to increase BN precipitation/B segregated site for the purpose of reducing the amount of B segregated in the austenite grain boundary.

Ti: 0.001 to 0.05%

Ti serves as a core of MnS, and forms TiN that makes MnS fine. TiN absorbs solute B and solute N to form composite nitride. This reduces the amount of B segregated in the austenite grain boundary (in other words, the amount of B improving the hardenability) causing variations in hardenability. In the case where Ti is less than 0.001%, the effect obtained from the additive does not occur. On the other hand, in the case where Ti exceeds 0.05%, Ti-based sulfide is generated. This reduces the amount of MnS that improves the machinability, deteriorating the machinability of the steel. Thus, the amount of Ti is set to be in the range of 0.001 to 0.05%.

The steel material for hardening according to this embodiment may contain at least one element selected from the group consisting of Cr, Mo, Cu, Ni, Ca, Zr, Mg, REM, Nb, V, W, Sb, Sn, Zn, Te, Bi, and Pb. These elements are contained optionally in the steel, and hence, the lower limit values of these elements are 0%. However, in order to favorably obtain the effect obtained by adding each of the elements, the following lower limit values may be set.

The steel material for hardening according to this embodiment may contain one or more elements selected from Cr, Mo, Cu, and Ni for the purpose of improving the hardenability or strength.

Cr: 0.1 to 3.0%

Cr is an element for improving the hardenability and providing resistance to temper softening. This element is added to steel required to have high strength. In the case where Cr is less than 0.2%, the effect of the additive cannot be obtained, and on the other hand, in the case where Cr exceeds 3.0%, Cr carbide is generated, and hence, the steel becomes embrittled. Thus, the amount of Cr is set to be in the range of 0.1 to 3.0%.

Mo: 0.01 to 1.5%

Mo is an element for providing resistance to temper softening, and improving the hardenability. This element is added to steel required to have high strength. In the case where Mo is less than 0.01%, the effect of the additive cannot be obtained, and on the other hand, in the case where Cr exceeds 1.5%, the effect obtained from the additive saturates. Thus, the amount of Mo is set to be in the range of 0.01% to 1.5%.

Cu: 0.1 to 2.0%

Cu strengthens ferrite, and is effective in improving the hardenability and the corrosion resistance. In the case where Cu is less than 0.1%, the effect of the additive cannot be obtained, and on the other hand, in the case where Cu exceeds 2.0%, the effect of improving the mechanical properties saturates. Thus, the amount of Cu is set to be in the range of 0.1 to 2.0%. Note that Cu deteriorates the hot rolling property, and is likely to cause defects at the time of rolling. Thus, it is preferable to add Ni at the time of adding Cu.

Ni: 0.1 to 5.0%

Ni strengthens ferrite, and is effective in improving the rolling property and improving the hardenability and the corrosion resistance. In the case where Ni is less than 0.1%, the effect of the additive cannot be obtained. On the other hand, in the case where Ni exceeds 5.0%, the effect of improving the mechanical properties saturates, and the machinability deteriorates. Thus, the amount of Ni is set to be in the range of 0.1 to 5.0%.

Further, the steel material for hardening according to this embodiment may contain one or more elements selected from Ca, Zr, Mg, and REM for the purpose of adjusting the deoxidization to control the formation of sulfide.

Ca: 0.0002 to 0.005%

Ca is an element for deoxidization, and generates oxide. As is the case with the steel material for hardening according to this embodiment, a steel containing Al of over 0.06% as total Al (T-Al) has calcium-aluminate ($CaO—Al_2O_3$). $CaO—Al_2O_3$ is an oxide having a lower melting point as compared with $Al_2O_3$, and hence, serves as the coating for protecting the tool at the time of high-speed cutting, thereby improving the machinability. In the case where Ca is less than 0.0002%, the effect of improving the machinability cannot be obtained. On the other hand, in the case where Ca exceeds 0.005%, CaS is generated in the steel, thereby deteriorating the machinability. Thus, the amount of Ca is set to be in the range of 0.0002 to 0.005%.

Zr: 0.0003 to 0.005%.

Zr is an element for deoxidization, and generates oxide in the steel. Oxide thereof is considered to be $ZrO_2$. $ZrO_2$ serves as a core of precipitation of MnS, and thus, increases the precipitation site of the MnS and disperses the MnS in a uniform manner. Further, Zr is contained in MnS in a solid solution state to form composite sulfide, lower its deformability, thereby suppressing the stretching of MnS at the time of rolling or hot forging. As described above, Zr is an element effective in reducing the anisotropy of the steel.

In the case where Zn is less than 0.0003%, the conspicuous effect of the additive cannot be obtained. On the other hand, in the case where Zr exceeds 0.005%, the yield extremely deteriorates, and a large amount of hard chemical compound such as $ZrO_2$ and ZrS is generated. Thus, the mechanical properties such as machinability, impact value and fatigue properties deteriorate. For this reason, the amount of Zr is set to be in the range of 0.0003 to 0.005%.

Mg: 0.0003 to 0.005%

Mg is an element for deoxidization, and forms oxide in the steel. The oxide serves as a core of MnS, and finely disperses MnS. In the case where Al deoxidization is performed, Mg modifies $Al_2O_3$, which adversely affects the machinability, into MgO or $Al_2O_3$.MgO which is relatively soft and finely disperses. Further, Mg forms composite sulfide with MnS, and makes MnS spheroidizing.

In the case where Mg is less than 0.0003%, the effect of the additive cannot be obtained. On the other hand, in the case where Mg exceeds 0.005%, generation of single MgS is promoted, and thus, the machinability deteriorates. Thus, the amount of Mg is set to be in the range of 0.0003% to 0.005%.

REM: 0.0001 to 0.015%

REM (rare-earth element) is an element for deoxidization, and forms oxide having a lower melting point. This prevents the nozzle from clogging at the time of casting. Further, REM is contained in MnS in a solid solution state or bonds to MnS, and lowers its deformability, thereby preventing the stretching of the MnS shape at the time of rolling and hot forging. As described above, REM is an element effective in reducing the anisotropy of the mechanical properties.

In the case where REM is less than 0.0001%, the effect obtained from the additive cannot be sufficiently generated. On the other hand, in the case where Ca exceeds 0.015%, a large amount of sulfide of REM is generated, and thus, the machinability deteriorates. Thus, the amount of REM is set to be in the range of 0.0001 to 0.015%.

Further, the steel material for hardening according to this embodiment may contain one or more elements selected from Nb, V and W for the purpose of strengthening resulting from formation of carbonitride, and regulating the grain size of the austenite grain and making the austenite grain fine resulting from the increase in the amount of carbonitride.

Nb: 0.01 to 0.1%

Nb forms carbonitride, and contributes to strengthening the steel by secondary precipitation hardening, suppressing the growth of austenite grain and strengthening the austenite grain. This element is added to steel required to have high strength, and steel required to have low strain as a grain-size-regulating element for preventing the coarsening of the grain.

In the case where Nb is less than 0.01%, the effect of increasing the strength cannot be obtained. On the other hand, in the case where Nb exceeds 0.1%, Nb forms coarsened carbonitride in non-solid-solution form, which causes hot cracking, and the mechanical properties deteriorate. Thus, the amount of Nb is set to be in the range of 0.01% to 0.1%.

V: 0.03 to 1.0%

V forms carbonitride, and is an element for strengthening the steel by the secondary precipitation hardening. This element is added, depending on application, to steel required to have high strength. In the case where V is less than 0.03%, the effect of increasing the strength cannot be obtained. On the other hand, in the case where V exceeds 1.0%, V forms the coarsened carbonitride in non-solid-solution form, which causes hot cracking, and the mechanical properties deteriorate. Thus, the amount of V is set to be in the range of 0.03% to 1.0%.

W: 0.01 to 1.0%

W forms carbonitride, and is an element for strengthening the steel by secondary precipitation hardening. In the case where W is less than 0.01%, the effect of increasing the strength cannot be obtained. On the other hand, in the case where W exceeds 1.0%, W forms the coarsened carbonitride in non-solid-solution form, which causes hot cracking, and the mechanical properties deteriorate. Thus, the amount of W is set to be in the range of 0.01% to 1.0%.

Further, the steel material for hardening according to this embodiment may contain one or more elements selected from Sb, Sn, Zn, Te, Bi, and Pb for the purpose of improving the machinability.

Sb: 0.0005 to 0.0150%

Sb moderately embrittles ferrite, and improves the machinability. The effect of Sb is remarkable in the case where the amount of solute Al is large. However, in the case where Sb is less than 0.0005%, the effect obtained from the additive does not appear. On the other hand, in the case where Sb exceeds 0.0150%, the macro segregation of Sb is excessive, which leads to a large reduction in the impact value. Thus, the amount of Sb is set to be in the range of 0.0005% to 0.0150%.

Sn: 0.005 to 2.0%

Sn moderately embrittles ferrite to prolong the lifetime of the tool and improve the surface roughness. In the case where Sn is less than 0.005%, the effect obtained from the additive does not appear. On the other hand, in the case where Sn exceeds 2.0%, the effect obtained from the additive saturates. Thus, the amount of Sn is set to be in the range of 0.005% to 2.0%.

Zn: 0.0005 to 0.5%

Zn embrittles ferrite to prolong the lifetime of the tool and improve the surface roughness. In the case where Zn is less than 0.0005%, the effect obtained from the additive does not appear. On the other hand, in the case where Zn exceeds 0.5%, the effect obtained from the additive saturates. Thus, the amount of Zn is set to be in the range of 0.0005% to 0.5%.

Te: 0.0003 to 0.2%

Te is an element for improving the machinability. Te forms MnTe, and coexists with MnS to reduce the deformability of MnS, thereby suppressing stretching of the MnS shape. As described above, Te is an element effective in reducing the anisotropy in the mechanical properties. In the case where Te is less than 0.0003%, the effect obtained from the additive does not appear. On the other hand, in the case where Te exceeds 0.2%, the effect obtained from the additive saturates, and Te deteriorates the hot rolling properties, which is likely to cause defects. Thus, the amount of Te is set to be in the range of 0.0003% to 0.2%.

Bi: 0.005 to 0.5%

Bi is an element for improving the machinability. In the case where Bi is less than 0.005%, the effect of improving the machinability cannot be obtained. On the other hand, in the case where Bi exceeds 0.5%, the effect of improving the machinability saturates, and Bi deteriorates the hot rolling properties, which is likely to cause defects. Thus, the amount of Bi is set to be in the range of 0.005% to 0.5%.

Pb: 0.005 to 0.5%

Pb is an element for improving the machinability. In the case where Pb is less than 0.005%, the effect of improving the machinability cannot be obtained. On the other hand, in the case where Pb exceeds 0.5%, the effect of improving the machinability saturates, and Pb deteriorates the hot rolling properties, which is likely to cause defects. Thus, the amount of Pb is set to be in the range of 0.005% to 0.5%.

The remainder of the element composition of the steel material for hardening according to this embodiment includes inevitable impurities containing B of 0.0004% or less as described above, and Fe.

The inevitable impurities may include a component other than the above-described components as long as the component is in an amount that does not inhibit the effects of the present invention. However, it is preferable to set the amount to be 0% as much as possible.

Next, a description will be made of the Jominy hardness used as an index indicating the hardening stability of the steel material for hardening according to this embodiment.

The steel material for hardening according to the present invention is characterized in that R and H satisfy the following Equation (2), where "R" is a hardness HRC at a position 5 mm measured from the quenching end and "H" is a calculation hardness HRC at a position 3/16 inch, in other words, a position 4.763 mm measured from the quenching end, the R and the H being measured according to the hardenability test by end quenching (Jominy test) specified by JIS G 0561.

$$H \times 0.948 \leqq R \leqq H \times 1.05 \qquad \text{Equation (2)}$$

The above-described "calculation hardness HRC at a position 3/16 inch from the quenching end" can be obtained through a procedure described in pages 67 to 68 of "5.3 Method for obtaining the Jominy curve by knowing C % and $D_I$ ($D_I$ method)" in "5 Method for obtaining the Jominy curve through a calculation" of Non-patent Document 1 with a distance measured from a water-cooling end being 3/16 inch (In this procedure, a $D_I$ value is calculated according to "A-255" of ASTM).

Next, a method for obtaining the "H" defined as "calculation hardness HRC at a distance of 3/16 inch from the quenching end" will be described.

[Procedure 1] First, on the basis of C % of the steel, the "50% martensite hardness" is obtained from Table 1 (Table 5.8 on page 67 in the above-described Non-patent Document 1).

TABLE 1

| C % | $H_RC$ |
|---|---|
| 0.15 | 28.5 |
| 0.16 | 29.0 |
| 0.17 | 30.0 |
| 0.18 | 30.5 |
| 0.19 | 31.0 |
| 0.20 | 31.5 |
| 0.21 | 32.0 |
| 0.22 | 32.5 |
| 0.23 | 33.5 |
| 0.24 | 34.0 |
| 0.25 | 34.5 |
| 0.26 | 35.0 |
| 0.27 | 36.0 |
| 0.28 | 36.5 |
| 0.29 | 37.0 |
| 0.30 | 37.5 |
| 0.31 | 38.0 |
| 0.32 | 38.5 |
| 0.33 | 39.0 |
| 0.34 | 40.0 |
| 0.35 | 40.5 |
| 0.36 | 41.0 |
| 0.37 | 41.5 |
| 0.38 | 42.0 |
| 0.39 | 42.5 |
| 0.40 | 43.0 |
| 0.41 | 43.5 |
| 0.42 | 44.0 |
| 0.43 | 44.5 |
| 0.44 | 45.0 |
| 0.45 | 45.5 |
| 0.46 | 46.0 |
| 0.47 | 46.0 |
| 0.48 | 46.5 |
| 0.49 | 47.0 |
| 0.50 | 47.5 |
| 0.51 | 48.0 |
| 0.52 | 48.5 |
| 0.53 | 48.5 |
| 0.54 | 49.0 |
| 0.55 | 49.0 |
| 0.56 | 49.5 |
| 0.57 | 50.0 |
| 0.58 | 50.0 |

TABLE 1-continued

| C % | $H_RC$ |
|---|---|
| 0.59 | 50.5 |
| 0.60 | 51.0 |

[Procedure 2] Next, a Di value is calculated according to "A-255" of American Society for Testing and Material (ASTM) using the following Equation (3).

$$Di(inch)=F(C)\times F(Mn)\times F(Si)\times F(Ni)\times F(Cr)\times F(Mo)\times F(Cu)\times F(V) \quad \text{Equation (3),}$$

where $F(Si)=1.00+0.7\times[Si]$, $F(Ni)=1.00+0.363\times[Ni]$, $F(Cr)=1.00+2.16\times[Cr]$, $F(Mo)=1.00+3.00\times[Mo]$, $F(Cu)=1.00+0.365\times[Cu]$, and $F(V)=1.00+1.73\times[V]$.

F(C) and F(Mn) are obtained as described below according to the amount of C (mass %) or the amount of Mn (mass %).

In the case of $[C]\leqq 0.39$ mass %, $F(C)=0.54\times[C]$

In the case of $0.39$ mass $\%<[C]\leqq 0.55$ mass %, $F(C)=0.171+0.001\times[C]+0.265\times[C]^2$ In the case of $0.55$ mass $\%<[C]\leqq 0.65$ mass %, $F(C)=0.115+0.268\times[C]-0.038\times[C]^2$ In the case of $0.65$ mass $\%<[C]\leqq 0.75$ mass %, $F(C)=0.143+0.2\times[C]$ In the case of $0.75$ mass $\%<[C]$, $F(C)=0.062+0.409\times[C]-0.135\times[C]^2$ In the case of $[Mn]\leqq 1.20$ mass %, $F(Mn)=3.3333\times[Mn]+1.00$ In the case of $1.20$ mass $\%<[Mn]$, $F(Mn)=5.10\times[Mn]-1.12$ It should be noted that, in the Equations above, the [element] indicates the amount (mass %) of the element in the steel.

From the thus obtained Di values and Table 2 (Table 5.7 on pages 65 to 66 of the above-described Non-patent Document 1), the "hardness value to be added to the 50% martensite hardness" at a position 3/16 inch away from the water-cooling end is obtained.

TABLE 2

| Di value | Di value | Distance (1/16 inch) from water-cooling end and hardness value to be added to 50% martensite hardness | | | | | | | | | | | | | | | | |
|---|---|---|---|---|---|---|---|---|---|---|---|---|---|---|---|---|---|---|
| (inch) | (mm) | 1 | 2 | 3 | 4 | 5 | 6 | 7 | 8 | 9 | 10 | 11 | 12 | 13 | 14 | 15 | 16 | 17 |
| 1.00 | 25.40 | 11.5 | 1.0 | | | | | | | | | | | | | | | |
| 1.20 | 30.48 | 13.0 | 4.5 | | | | | | | | | | | | | | | |
| 1.40 | 35.56 | 14.0 | 9.0 | 0.0 | | | | | | | | | | | | | | |
| 1.60 | 40.64 | 14.0 | 11.0 | 4.5 | | | | | | | | | | | | | | |
| 1.80 | 45.72 | 14.0 | 12.0 | 7.0 | 0.0 | | | | | | | | | | | | | |
| 2.00 | 50.80 | 14.0 | 12.5 | 9.5 | 3.5 | | | | | | | | | | | | | |
| 2.20 | 55.88 | 14.0 | 13.0 | 10.5 | 6.5 | | | | | | | | | | | | | |
| 2.40 | 60.96 | 14.0 | 13.5 | 11.0 | 8.0 | 3.0 | | | | | | | | | | | | |
| 2.60 | 66.04 | 14.0 | 13.5 | 11.5 | 9.5 | 5.5 | 1.5 | | | | | | | | | | | |
| 2.80 | 71.12 | 14.0 | 13.5 | 12.0 | 10.0 | 7.5 | 4.0 | 1.0 | | | | | | | | | | |
| 3.00 | 76.20 | 14.0 | 13.5 | 12.5 | 11.0 | 9.0 | 6.0 | 3.0 | 1.0 | | | | | | | | | |
| 3.20 | 81.28 | 14.0 | 14.0 | 13.0 | 11.5 | 9.5 | 7.5 | 5.0 | 2.5 | 0.5 | | | | | | | | |
| 3.40 | 86.36 | 14.0 | 14.0 | 13.0 | 12.0 | 10.5 | 9.0 | 7.0 | 4.5 | 2.5 | 0.0 | | | | | | | |
| 3.60 | 91.44 | 14.0 | 14.0 | 13.0 | 12.0 | 11.0 | 9.5 | 8.0 | 6.5 | 4.5 | 2.5 | 0.0 | | | | | | |
| 3.80 | 96.52 | 14.0 | 14.0 | 13.0 | 12.5 | 11.5 | 10.0 | 9.0 | 8.0 | 6.0 | 4.0 | 2.0 | 0.0 | | | | | |
| 4.00 | 101.60 | 14.0 | 14.0 | 13.5 | 12.5 | 12.0 | 11.0 | 10.0 | 9.0 | 7.5 | 6.0 | 4.0 | 2.0 | 0.0 | | | | |
| 4.20 | 106.68 | 14.0 | 14.0 | 13.5 | 13.0 | 12.0 | 11.0 | 10.5 | 9.5 | 8.5 | 7.5 | 5.5 | 4.0 | 2.0 | 0.5 | | | |

TABLE 2-continued

| | | | | | | | | | | | | | | | | | | |
|---|---|---|---|---|---|---|---|---|---|---|---|---|---|---|---|---|---|---|
| 4.40 | 111.76 | 14.0 | 14.0 | 13.5 | 13.0 | 12.5 | 11.5 | 11.0 | 10.0 | 9.0 | 8.0 | 7.0 | 5.5 | 4.0 | 2.0 | 0.5 | | |
| 4.60 | 116.84 | 14.0 | 14.0 | 13.5 | 13.0 | 12.5 | 12.0 | 11.5 | 11.0 | 10.0 | 9.0 | 8.0 | 7.0 | 5.0 | 4.0 | 2.0 | 0.5 | |
| 4.80 | 121.92 | 14.0 | 14.0 | 13.5 | 13.0 | 13.0 | 12.5 | 12.0 | 11.0 | 10.5 | 10.0 | 9.0 | 8.0 | 7.0 | 5.5 | 4.0 | 2.5 | 1.0 |
| 5.00 | 127.00 | 14.0 | 14.0 | 13.5 | 13.5 | 13.0 | 12.5 | 12.0 | 11.5 | 11.0 | 10.5 | 9.5 | 9.0 | 8.0 | 7.0 | 5.5 | 4.0 | 3.0 |
| 5.20 | 132.08 | 14.0 | 14.0 | 13.5 | 13.5 | 13.0 | 12.5 | 12.0 | 12.0 | 11.5 | 11.0 | 10.0 | 9.5 | 8.5 | 8.0 | 7.0 | 5.5 | 4.5 |
| 5.40 | 137.16 | 14.0 | 14.0 | 13.5 | 13.5 | 13.0 | 13.0 | 12.5 | 12.0 | 11.5 | 11.0 | 10.5 | 10.0 | 9.0 | 8.5 | 8.0 | 6.5 | 5.5 |
| 5.60 | 142.24 | 14.0 | 14.0 | 14.0 | 13.5 | 13.0 | 13.0 | 12.5 | 12.0 | 12.0 | 11.5 | 11.0 | 10.5 | 10.0 | 9.0 | 8.5 | 7.5 | 7.0 |
| 5.80 | 147.32 | 14.0 | 14.0 | 14.0 | 13.5 | 13.0 | 13.0 | 12.5 | 12.0 | 12.0 | 11.5 | 11.0 | 10.5 | 10.0 | 9.5 | 9.0 | 8.5 | 8.0 |
| 6.00 | 152.40 | 14.0 | 14.0 | 14.0 | 13.5 | 13.0 | 13.0 | 13.0 | 12.5 | 12.0 | 12.0 | 11.5 | 11.0 | 10.5 | 10.0 | 9.5 | 9.0 | 8.5 |
| 6.20 | 157.48 | 14.0 | 14.0 | 14.0 | 14.0 | 13.5 | 13.0 | 13.0 | 13.0 | 12.5 | 12.0 | 12.0 | 11.5 | 11.0 | 10.5 | 10.0 | 9.5 | 9.0 |
| 6.40 | 162.56 | 14.0 | 14.0 | 14.0 | 14.0 | 13.5 | 13.0 | 13.0 | 13.0 | 13.0 | 12.5 | 12.0 | 12.0 | 11.5 | 11.0 | 10.5 | 10.0 | 9.5 |
| 6.60 | 167.64 | 14.0 | 14.0 | 14.0 | 14.0 | 13.5 | 13.0 | 13.0 | 13.0 | 13.0 | 12.5 | 12.0 | 12.0 | 11.5 | 11.0 | 10.5 | 10.0 | 9.5 |

| Di value | Distance (1/16 inch) from water-cooling end and hardness value to be added to 50% martensite hardness | | | | | | | | | | | | | | |
|---|---|---|---|---|---|---|---|---|---|---|---|---|---|---|---|
| (inch) | 18 | 19 | 20 | 21 | 22 | 23 | 24 | 25 | 26 | 27 | 28 | 29 | 30 | 31 | 32 |
| 1.00 | | | | | | | | | | | | | | | |
| 1.20 | | | | | | | | | | | | | | | |
| 1.40 | | | | | | | | | | | | | | | |
| 1.60 | | | | | | | | | | | | | | | |
| 1.80 | | | | | | | | | | | | | | | |
| 2.00 | | | | | | | | | | | | | | | |
| 2.20 | | | | | | | | | | | | | | | |
| 2.40 | | | | | | | | | | | | | | | |
| 2.60 | | | | | | | | | | | | | | | |
| 2.80 | | | | | | | | | | | | | | | |
| 3.00 | | | | | | | | | | | | | | | |
| 3.20 | | | | | | | | | | | | | | | |
| 3.40 | | | | | | | | | | | | | | | |
| 3.60 | | | | | | | | | | | | | | | |
| 3.80 | | | | | | | | | | | | | | | |
| 4.00 | | | | | | | | | | | | | | | |
| 4.20 | | | | | | | | | | | | | | | |
| 4.40 | | | | | | | | | | | | | | | |
| 4.60 | | | | | | | | | | | | | | | |
| 4.80 | | | | | | | | | | | | | | | |
| 5.00 | 1.5 | 0.0 | | | | | | | | | | | | | |
| 5.20 | 3.5 | 2.0 | 0.5 | | | | | | | | | | | | |
| 5.40 | 4.5 | 3.5 | 2.5 | 1.0 | 0.0 | | | | | | | | | | |
| 5.60 | 6.0 | 5.0 | 4.0 | 3.0 | 2.0 | 1.0 | | | | | | | | | |
| 5.80 | 7.0 | 6.0 | 5.0 | 4.0 | 3.5 | 2.5 | 1.5 | 0.5 | | | | | | | |
| 6.00 | 8.0 | 7.0 | 6.0 | 5.5 | 4.5 | 3.5 | 3.0 | 2.0 | 1.0 | 0.0 | | | | | |
| 6.20 | 8.5 | 8.0 | 7.0 | 6.5 | 6.0 | 5.0 | 4.0 | 3.5 | 2.5 | 2.0 | 1.0 | 0.5 | | | |
| 6.40 | 9.0 | 8.5 | 8.0 | 7.5 | 7.0 | 6.0 | 5.5 | 5.0 | 4.0 | 3.5 | 2.5 | 2.0 | 1.0 | 0.5 | |
| 6.60 | 9.0 | 9.0 | 8.5 | 8.0 | 7.5 | 6.5 | 6.0 | 5.5 | 4.5 | 4.0 | 3.0 | 2.5 | 2.0 | 1.0 | 0.5 |

It should be noted that the minimum unit for Di values in Table 2 is 0.2 inch, and hence, the hardness value to be added existing in this minimum unit is obtained through interpolation using a line. For example, in the case of Di=1.90 inch, the hardness number to be added at the position 3/16 inch measured from the water-cooling end is [7.0+(9.5−7.0)×0.1/0.2=8.25].

[Procedure 3] The "H" defined as "calculation hardness HRC at a distance of 3/16 inch from the quenching end" is obtained by adding the "hardness value to be added to the 50% martensite hardness" at the position 3/16 inch measured from the water-cooling end obtained in the (2) above to the "50% martensite hardness" obtained in the procedure 2.

If the steel having Al of over 0.06% is manufactured with the ordinary method, N is fixed as nitride, and B having the inevitable impurity volume is in a solid solution state. In this case, the solute B is segregated in the austenite grain boundary at the time of hardening, and hence, the hardenability is affected.

With the steel material for hardening according to this embodiment, the effect of B on the hardenability is eliminated as described above, and hence, it is possible to set the hardness at a position 5 mm measured from the quenching end measured through the hardenability test by end quenching (Jominy test) to fall within the hardness range (range indicated by Equation (2) above) under which the amount of Al is not made high.

The steel material for hardening according to this embodiment is manufactured by subjecting a steel piece having the above-described components to a first heat treatment. Further, after the first heat treatment, it may be possible to apply a second heat treatment (normalizing).

In the first heat treatment, before the hardening heat treatment, the steel material for hardening is heated to a high temperature of 1260° C. or more, and the high temperature is maintained for at least 20 minutes. However, the heating temperature can be lowered by increasing the amount of added Ti. That is, by setting the amount of Ti to more than or equal to 0.19%, it is only necessary to maintain the temperature of 1200° C. or more for at least 20 minutes, and by setting the amount of Ti to more than or equal to 0.25%, it is only necessary to maintain the temperature of 1150° C. or more for at least 20 minutes.

If the maintaining time duration is less than 20 minutes, MnS cannot be sufficiently made fine even if the appropriate heating temperature is applied. In this case, a large amount of the solute B, which can be segregated in the austenite grain boundary, remains, and hence, sufficient hardening stability cannot be obtained.

The first heat treatment may be applied at the time of heating a steel ingot for blooming or hot forging, or a continuous casting piece. Further, the first heat treatment may be applied at a given point in time when heating is applied for rolling the steel material or after the steel material is rolled. In other words, the first heat treatment can be applied at any time as long as the first heat treatment is applied before the hardening heat treatment, and the target of the first heat treatment is not limited to the metal structure of the steel.

It is only necessary to apply the second heat treatment (normalizing) according to the properties necessary for the part, and there is no specific limitation on the heating temperature and the maintaining time.

In the case where the amount of added Al exceeds 0.06%, N is generally fixed as nitride, and B having the inevitable impurity volume is in a solid solution state, which affects the hardenability. However, according to the steel material for hardening according to this embodiment, the following conditions (x) to (z) are satisfied, whereby it is possible to stabilize the hardenability.

(x) The amount of B in the inevitable impurities is limited to 0.0004 mass %.

(y) When the total amount (mass %) of N is denoted by [total N], and the amount of Ti (mass %) is denoted by [Ti], the [total N] and the [Ti] satisfy the following Equation (4).

$$0.006+[Ti]\times(14/48)\leqq[\text{total N}]\leqq 0.03 \qquad \text{Equation (4)}$$

(z) Before the hardening heat treatment, a temperature is raised to a high temperature of 1260° C. or more, and the high temperature is maintained for at least 20 minutes. However, the heating temperature can be lowered in the case where Ti is added. By setting the amount of Ti to more than or equal to 0.19%, it is only necessary to maintain the temperature of 1200° C. or more for at least 20 minutes, and by setting the amount of Ti to more than or equal to 0.25%, it is only necessary to maintain the temperature of 1150° C. or more for at least 20 minutes.

The condition (x) limits the total amount of B, which leads to a decrease in the amount of solute B. Further, the condition (y) enhances the precipitation of BN, which leads to a decrease in the amount of solute B. Yet further, the condition (z) makes a part of MnZ become in a solid solution state, and then, the part of MnZ precipitates, which makes MnS fine and increases the surface area of MnS. With the increase in the amount of added Ti, TiN increases. This leads to an increase in BN precipitating on MnS and TiN, or an increase in the amount of B segregated in the interface between different phases, in other words, between MnS/TiN and Fe-matrix. Therefore, the segregation amount of the solute B, which is originally segregated in the austenite grain boundary and has an effect on the hardenability, is reduced, and hence, the hardenability becomes stabilized.

The steel material for hardening described above may be used for a power-transmitting part such as a gear, a shaft, and a continuously variable transmission (CVT), by subjecting the steel material to the machine work and hardening.

EXAMPLES

Next, examples of the present invention will be described. The conditions in the examples are merely examples of those employed for confirming the applicability and effects of the present invention. Thus, the present invention is not limited to these examples of the conditions. The present invention may employ various conditions without departing from the gist of the present invention, provided that the object of the present invention can be achieved.

Test pieces for drill cutting and Jominy test pieces were prepared such that steel ingots having the chemical components shown in Table 3 and Table 4 were cogged into a diameter of 35 mm; then, a heat treatment 1 (heating before hardening heat treatment) and a heat treatment 2 (normalizing) shown in Table 5 were applied; and the resulting steels were subjected to machine work. For the test No. 31, the heat treatment 1 was not applied, and the heat treatment 2 was applied such that a heating temperature of 1250° C. was maintained for 0.5 hours, and then, accelerated cooling (AC) was applied. For the test No. 32, the heat treatment 1 was not applied, and the heat treatment 2 was applied such that a heating temperature of 1240° C. was maintained for 1.5 hours, and then, accelerated cooling (AC) was applied.

For the test Nos. 1, 2, 4 to 12, 14 to 18, 20 to 30, and 33 to 37, the heat treatment 2 was applied such that the heating temperature of 1250° C. was maintained for 0.5 hours, and then, cooling in the air was applied.

TABLE 3

| Test | Chemical component (mass %) | | | | | | | | | | |
|---|---|---|---|---|---|---|---|---|---|---|---|
| No. | C | Si | Mn | P | S | T•N | T•N-NasTiN | Al | Ti | B | Cr |
| 1 | 0.20 | 0.25 | 0.81 | 0.014 | 0.015 | 0.0081 | 0.0081 | 0.100 | | 0.0002 | 1.20 |
| 2 | 0.20 | 0.24 | 0.81 | 0.013 | 0.015 | 0.0085 | 0.0085 | 0.102 | | 0.0002 | 1.19 |
| 3 | 0.20 | 0.34 | 0.80 | 0.010 | 0.015 | 0.0090 | 0.0090 | 0.110 | | 0.0002 | 1.21 |
| 4 | 0.20 | 0.45 | 0.80 | 0.015 | 0.016 | 0.0126 | 0.0082 | 0.098 | 0.015 | 0.0003 | 1.23 |
| 5 | 0.20 | 0.26 | 0.79 | 0.016 | 0.017 | 0.0119 | 0.0081 | 0.087 | 0.013 | 0.0002 | 1.24 |
| 6 | 0.39 | 0.38 | 1.19 | 0.014 | 0.015 | 0.0091 | 0.0091 | 0.095 | | 0.0002 | 0.01 |
| 7 | 0.20 | 0.29 | 0.79 | 0.013 | 0.016 | 0.0081 | 0.0081 | 0.104 | | 0.0002 | 0.75 |
| 8 | 0.20 | 0.24 | 0.80 | 0.010 | 0.014 | 0.0092 | 0.0092 | 0.089 | | 0.0002 | 1.19 |
| 9 | 0.21 | 0.23 | 0.81 | 0.011 | 0.015 | 0.0083 | 0.0083 | 0.120 | | 0.0002 | 1.23 |
| 10 | 0.20 | 0.27 | 0.74 | 0.012 | 0.015 | 0.0079 | 0.0079 | 0.099 | | 0.0003 | 1.20 |
| 11 | 0.21 | 0.31 | 0.80 | 0.013 | 0.020 | 0.0081 | 0.0081 | 0.098 | | 0.0002 | 1.20 |
| 12 | 0.20 | 0.24 | 0.79 | 0.014 | 0.014 | 0.0082 | 0.0082 | 0.115 | | 0.0002 | 1.20 |
| 13 | 0.20 | 0.21 | 0.80 | 0.015 | 0.014 | 0.0079 | 0.0079 | 0.123 | | 0.0002 | 1.20 |
| 14 | 0.20 | 0.19 | 0.73 | 0.013 | 0.014 | 0.0078 | 0.0078 | 0.151 | | 0.0002 | 1.24 |
| 15 | 0.20 | 0.24 | 0.82 | 0.016 | 0.016 | 0.0099 | 0.0099 | 0.142 | | 0.0002 | 1.20 |
| 16 | 0.25 | 0.22 | 0.83 | 0.014 | 0.015 | 0.0094 | 0.0094 | 0.123 | | 0.0003 | 1.19 |
| 17 | 0.22 | 0.24 | 0.91 | 0.015 | 0.016 | 0.0082 | 0.0082 | 0.116 | | 0.0002 | 1.21 |
| 18 | 0.24 | 0.23 | 0.79 | 0.016 | 0.015 | 0.0080 | 0.0080 | 0.132 | | 0.0002 | 1.20 |
| 19 | 0.21 | 0.28 | 0.79 | 0.015 | 0.015 | 0.0081 | 0.0081 | 0.145 | | 0.0002 | 1.21 |
| 20 | 0.23 | 0.29 | 0.79 | 0.013 | 0.015 | 0.0083 | 0.0083 | 0.110 | | 0.0002 | 1.19 |
| 21 | 0.20 | 0.33 | 0.73 | 0.012 | 0.016 | 0.0078 | 0.0078 | 0.097 | | 0.0002 | 1.05 |
| 22 | 0.20 | 0.21 | 0.81 | 0.014 | 0.015 | 0.0081 | 0.0081 | 0.101 | | 0.0002 | 1.20 |

TABLE 3-continued

| Test | Chemical component (mass %) | | | | | | | | | | |
|---|---|---|---|---|---|---|---|---|---|---|---|
| No. | C | Si | Mn | P | S | T•N | T•N-NasTiN | Al | Ti | B | Cr |
| 23 | 0.20 | 0.25 | 0.75 | 0.013 | 0.014 | 0.0079 | 0.0079 | 0.099 | | 0.0002 | 1.19 |
| 24 | 0.20 | 0.24 | 0.74 | 0.012 | 0.016 | 0.0078 | 0.0078 | 0.098 | | 0.0002 | 1.20 |
| 25 | 0.20 | 0.26 | 0.80 | 0.016 | 0.012 | 0.0077 | 0.0077 | 0.103 | | 0.0002 | 1.21 |
| 26 | 0.21 | 0.27 | 0.74 | 0.011 | 0.013 | 0.0118 | 0.0077 | 0.110 | 0.014 | 0.0003 | 1.20 |
| 27 | 0.22 | 0.21 | 0.81 | 0.015 | 0.014 | 0.0114 | 0.0079 | 0.102 | 0.012 | 0.0002 | 1.21 |
| 28 | 0.20 | 0.24 | 0.81 | 0.015 | 0.015 | 0.0086 | 0.0086 | 0.102 | | 0.0006 | 1.21 |
| 29 | 0.20 | 0.22 | 0.80 | 0.013 | 0.015 | 0.0085 | 0.0085 | 0.040 | | 0.0002 | 1.20 |
| 30 | 0.20 | 0.19 | 0.80 | 0.011 | 0.016 | 0.0041 | 0.0041 | 0.111 | | 0.0002 | 1.20 |
| 31 | 0.20 | 0.22 | 0.80 | 0.012 | 0.015 | 0.0089 | 0.0089 | 0.110 | | 0.0002 | 1.20 |
| 32 | 0.20 | 0.24 | 0.80 | 0.013 | 0.014 | 0.0084 | 0.0084 | 0.096 | | 0.0002 | 1.20 |
| 33 | 0.21 | 0.24 | 0.79 | 0.014 | 0.015 | 0.0155 | 0.0091 | 0.099 | 0.022 | 0.0002 | 1.20 |
| 34 | 0.20 | 0.21 | 0.80 | 0.015 | 0.014 | 0.0146 | 0.0070 | 0.103 | 0.026 | 0.0003 | 1.19 |
| 35 | 0.21 | 0.23 | 0.75 | 0.013 | 0.014 | 0.0221 | 0.0084 | 0.102 | 0.047 | 0.0002 | 1.21 |
| 36 | 0.20 | 0.23 | 0.82 | 0.016 | 0.016 | 0.0099 | 0.0099 | 0.111 | | 0.0004 | 1.21 |
| 37 | 0.25 | 0.22 | 0.83 | 0.016 | 0.015 | 0.0098 | 0.0098 | 0.098 | | 0.0001 | 1.20 |

TABLE 4

| Test | Chemical component (mass %) | | | | | | | | | | |
|---|---|---|---|---|---|---|---|---|---|---|---|
| No. | Mo | Cu | Ni | Nb | V | W | Ca | Zr | Mg | REM | Others |
| 1 | | | | | | | | | | | |
| 2 | | | | | | | | | | | |
| 3 | | | | | | | | | | | |
| 4 | | | | | | | | | | | |
| 5 | | | | | | | | | | | |
| 6 | | | | | | | | | | | |
| 7 | 0.16 | | | | | | | | | | |
| 8 | | 0.20 | | | | | | | | | |
| 9 | | 0.21 | 0.20 | | | | | | | | |
| 10 | | | | | | | 0.0010 | | | | |
| 11 | | | | | | | | 0.0006 | | | |
| 12 | | | | | | | | | 0.0006 | | |
| 13 | | | | | | | | | | 0.0006 | |
| 14 | | | | 0.02 | | | | | | | |
| 15 | | | | | 0.10 | | | | | | |
| 16 | | | | | | 0.03 | | | | | |
| 17 | | | | | | | | | | | Sb: 0.0007 |
| 18 | | | | | | | | | | | Sn: 0.01 |
| 19 | | | | | | | | | | | Zn: 0.001 |
| 20 | | | | | | | | | | | Te: 0.001 |
| 21 | | | | | | | | | | | Bi: 0.04 |
| 22 | | | | | | | | | | | Pb: 0.08 |
| 23 | | | | | | | | | | | |
| 24 | | | | | | | | | | | |
| 25 | | | | | | | | | | | |
| 26 | 0.16 | | | | | | | | | | |
| 27 | 0.15 | | | 0.01 | | | | | | | |
| 28 | | | | | | | | | | | |
| 29 | | | | | | | | | | | |
| 30 | | | | | | | | | | | |
| 31 | | | | | | | | | | | |
| 32 | | | | | | | | | | | |
| 33 | | | | | | | | | | | |
| 34 | | | | | | | | | | | |
| 35 | | | | | | | | | | | |
| 36 | | | | | | | | | | | |
| 37 | | | | | | | | | | | |

TABLE 5

| Test No. | Heat treatment: Heat treatment 1 | Heat treatment 2 | Heat treatment 3 |
|---|---|---|---|
| 1 | 1300° C. × 2 hours and then, cooling in the air | 1250° C. × 0.5 hours and then, cooling in the air | 925° C. × 1 hour and then, cooling in the air |
| 2 | 1300° C. × 2 hours and then, cooling in the air | 1250° C. × 0.5 hours and then, cooling in the air | 925° C. × 1 hour and then, cooling in the air |
| 3 | 1300° C. × 2 hours and then, cooling in the air | Not applied | 925° C. × 1 hour and then, cooling in the air |
| 4 | 1300° C. × 2 hours and then, cooling in the air | 1250° C. × 0.5 hours and then, cooling in the air | 925° C. × 1 hour and then, cooling in the air |
| 5 | 1300° C. × 2 hours and then, cooling in the air | 1250° C. × 0.5 hours and then, cooling in the air | 925° C. × 1 hour and then, cooling in the air |
| 6 | 1300° C. × 2 hours and then, cooling in the air | 1250° C. × 0.5 hours and then, cooling in the air | 900° C. × 1 hour and then, cooling in the air |
| 7 | 1300° C. × 2 hours and then, cooling in the air | 1250° C. × 0.5 hours and then, cooling in the air | 925° C. × 1 hour and then, cooling in the air |
| 8 | 1300° C. × 2 hours and then, cooling in the air | 1250° C. × 0.5 hours and then, cooling in the air | 925° C. × 1 hour and then, cooling in the air |
| 9 | 1300° C. × 2 hours and then, cooling in the air | 1250° C. × 0.5 hours and then, cooling in the air | 925° C. × 1 hour and then, cooling in the air |
| 10 | 1300° C. × 2 hours and then, cooling in the air | 1250° C. × 0.5 hours and then, cooling in the air | 925° C. × 1 hour and then, cooling in the air |
| 11 | 1300° C. × 2 hours and then, cooling in the air | 1250° C. × 0.5 hours and then, cooling in the air | 925° C. × 1 hour and then, cooling in the air |
| 12 | 1300° C. × 2 hours and then, cooling in the air | 1250° C. × 0.5 hours and then, cooling in the air | 925° C. × 1 hour and then, cooling in the air |
| 13 | 1300° C. × 2 hours and then, cooling in the air | Not applied | 925° C. × 1 hour and then, cooling in the air |
| 14 | 1300° C. × 2 hours and then, cooling in the air | 1250° C. × 0.5 hours and then, cooling in the air | 925° C. × 1 hour and then, cooling in the air |
| 15 | 1300° C. × 2 hours and then, cooling in the air | 1250° C. × 0.5 hours and then, cooling in the air | 925° C. × 1 hour and then, cooling in the air |
| 16 | 1300° C. × 2 hours and then, cooling in the air | 1250° C. × 0.5 hours and then, cooling in the air | 925° C. × 1 hour and then, cooling in the air |
| 17 | 1300° C. × 2 hours and then, cooling in the air | 1250° C. × 0.5 hours and then, cooling in the air | 925° C. × 1 hour and then, cooling in the air |
| 18 | 1300° C. × 2 hours and then, cooling in the air | 1250° C. × 0.5 hours and then, cooling in the air | 925° C. × 1 hour and then, cooling in the air |
| 19 | 1300° C. × 2 hours and then, cooling in the air | Not applied | 925° C. × 1 hour and then, cooling in the air |
| 20 | 1300° C. × 2 hours and then, cooling in the air | 1250° C. × 0.5 hours and then, cooling in the air | 925° C. × 1 hour and then, cooling in the air |
| 21 | 1300° C. × 2 hours and then, cooling in the air | 1250° C. × 0.5 hours and then, cooling in the air | 925° C. × 1 hour and then, cooling in the air |
| 22 | 1300° C. × 2 hours and then, cooling in the air | 1250° C. × 0.5 hours and then, cooling in the air | 925° C. × 1 hour and then, cooling in the air |
| 23 | 1300° C. × 2 hours and then, cooling in the air | 1250° C. × 0.5 hours and then, cooling in the air | 925° C. × 1 hour and then, cooling in the air |
| 24 | 1300° C. × 2 hours and then, cooling in the air | 1250° C. × 0.5 hours and then, cooling in the air | 925° C. × 1 hour and then, cooling in the air |
| 25 | 1300° C. × 2 hours and then, cooling in the air | 1250° C. × 0.5 hours and then, cooling in the air | 925° C. × 1 hour and then, cooling in the air |
| 26 | 1300° C. × 2 hours and then, cooling in the air | 1250° C. × 0.5 hours and then, cooling in the air | 925° C. × 1 hour and then, cooling in the air |
| 27 | 1300° C. × 2 hours and then, cooling in the air | 1250° C. × 0.5 hours and then, cooling in the air | 925° C. × 1 hour and then, cooling in the air |
| 28 | 1300° C. × 2 hours and then, cooling in the air | 1250° C. × 0.5 hours and then, cooling in the air | 925° C. × 1 hour and then, cooling in the air |
| 29 | 1300° C. × 2 hours and then, cooling in the air | 1250° C. × 0.5 hours and then, cooling in the air | 925° C. × 1 hour and then, cooling in the air |
| 30 | 1300° C. × 2 hours and then, cooling in the air | 1250° C. × 0.5 hours and then, cooling in the air | 925° C. × 1 hour and then, cooling in the air |
| 31 | Not applied | 1250° C. × 0.5 hours and then, AC | 925° C. × 1 hour and then, cooling in the air |
| 32 | Not applied | 1240° C. × 1.5 hours and then, AC | 925° C. × 1 hour and then, cooling in the air |
| 33 | 1200° C. × 2 hours and then, cooling in the air | 1250° C. × 0.5 hours and then, cooling in the air | 925° C. × 1 hour and then, cooling in the air |
| 34 | 1200° C. × 2 hours and then, cooling in the air | 1250° C. × 0.5 hours and then, cooling in the air | 925° C. × 1 hour and then, cooling in the air |
| 35 | 1150° C. × 2 hours and then, cooling in the air | 1250° C. × 0.5 hours and then, cooling in the air | 925° C. × 1 hour and then, cooling in the air |
| 36 | 1300° C. × 2 hours and then, cooling in the air | 1250° C. × 0.5 hours and then, cooling in the air | 925° C. × 1 hour and then, cooling in the air |
| 37 | 1300° C. × 2 hours and then, cooling in the air | 1250° C. × 0.5 hours and then, cooling in the air | 925° C. × 1 hour and then, cooling in the air |

The test pieces for drill cutting were each prepared by cutting out a cylindrical test piece having a diameter of 30 mm and a height of 21 mm, and applying the milling finish to the cut-out test piece. For the Jominy test pieces, a test piece having a flange specified in MS G 0561 was employed.

[Jominy Test]

The Jominy test was conducted through an end quenching method based on JIS G 0561 under conditions of a heat treatment 3 shown in Table 5. After grinding was applied to the test piece in accordance with the requirements of JIS, the Rockwell hardness with C scale was measured at a position 5 mm away from the hardening end.

[Machinability Test]

The machinability test was conducted such that each of the test pieces for drill cutting was subjected to a drill-boring test under the cutting conditions shown in Table 6, and the machinability of each of the steel materials for hardening of Examples and Comparative Examples was evaluated. As an evaluation index, the drill-boring test employed the maximum cutting rate VL 1000 (m/min) that enables cutting up to an accumulated hole depth of 1000 mm.

TABLE 6

| Cutting condition | | Drill | | Others | |
|---|---|---|---|---|---|
| Cutting rate | 1-100 m/min | Drill diameter | ϕ 3 mm | Hole depth | 9 mm |
| Feed | 0.25 mm/rev | NACHI normal drill | | Tool lifetime | Until tool breaks |
| Lubricant for cutting | Water-soluble cutting oil | | | | |
| | | Protruding amount | 45 mm | | |

(NACHI normal drill refers to a drill with a model type SD3.0 made by NACHI-FUJIKOSHI CORP. The outermost surface of this tool is made of iron-based oxide.)

Table 7 shows a hardness R and a hardness after the heat treatment 2 at a position 5 mm measured from the quenching end of the Jominy test, which are indices of the hardenability, and the examination results of the maximum cutting rate VL1000 (m/min), which is an index of the hardenability. The hardness R was measured with the number N being 5, and the maximum value, the minimum value, and the standard deviation of the measured hardness R were obtained.

TABLE 7

| | Calculation value | | | | Experimental value | | | | | |
|---|---|---|---|---|---|---|---|---|---|---|
| Test No. | Di value (mm) | H [HRC] | H × 0.948 [HRC] | H × 1.05 [HRC] | R (average) (HRC) | Maximum value (HRC) | Minimum value (HRC) | Standard deviation N = 5 | Hardness after heat treatment 2 (HV) | VL1000 (m/min) |
| 1 | 42.8 | 37.0 | 35.1 | 38.9 | 37.1 | 37.4 | 36.8 | 0.2 | 155 | 55 |
| 2 | 42.3 | 36.8 | 34.8 | 38.6 | 37.0 | 37.3 | 36.6 | 0.2 | 163 | 55 |
| 3 | 45.0 | 38.0 | 36.0 | 39.9 | 37.5 | 37.9 | 37.1 | 0.3 | 164 | 55 |
| 4 | 48.4 | 39.8 | 37.7 | 41.7 | 39.4 | 39.7 | 39.0 | 0.3 | 166 | 50 |
| 5 | 43.3 | 37.3 | 35.3 | 39.1 | 37.1 | 37.5 | 36.4 | 0.4 | 163 | 55 |
| 6 | 34.4 | 42.5 | 40.3 | 44.6 | 43.1 | 43.7 | 42.6 | 0.5 | 178 | 50 |
| 7 | 46.5 | 38.8 | 36.7 | 40.7 | 38.7 | 39.5 | 38.0 | 0.5 | 166 | 50 |
| 8 | 45.0 | 38.0 | 36.0 | 39.9 | 38.4 | 39.0 | 38.1 | 0.3 | 163 | 55 |
| 9 | 52.3 | 41.7 | 39.5 | 43.8 | 41.9 | 42.1 | 41.4 | 0.2 | 164 | 55 |
| 10 | 40.6 | 35.6 | 33.7 | 37.3 | 36.4 | 37.2 | 35.0 | 0.8 | 162 | 55 |
| 11 | 46.2 | 39.0 | 37.0 | 41.0 | 40.1 | 40.4 | 39.0 | 0.5 | 165 | 55 |
| 12 | 41.8 | 36.5 | 34.6 | 38.3 | 36.8 | 37.1 | 36.5 | 0.2 | 163 | 55 |
| 13 | 41.4 | 36.3 | 34.4 | 38.1 | 36.6 | 37.1 | 36.0 | 0.4 | 163 | 55 |
| 14 | 39.3 | 34.7 | 32.8 | 36.4 | 34.8 | 35.1 | 34.4 | 0.2 | 161 | 60 |
| 15 | 50.4 | 40.8 | 38.6 | 42.8 | 41.1 | 41.7 | 40.5 | 0.4 | 163 | 55 |
| 16 | 53.2 | 44.4 | 42.1 | 46.6 | 44.5 | 45.1 | 44.0 | 0.4 | 168 | 50 |
| 17 | 51.4 | 42.1 | 39.9 | 44.2 | 42.3 | 42.8 | 42.0 | 0.3 | 167 | 50 |
| 18 | 49.9 | 43.0 | 40.8 | 45.2 | 43.2 | 43.4 | 43.0 | 0.2 | 166 | 50 |
| 19 | 45.2 | 38.8 | 36.7 | 40.7 | 39.5 | 40.0 | 39.2 | 0.3 | 164 | 55 |
| 20 | 49.2 | 42.0 | 39.8 | 44.1 | 43.0 | 43.5 | 42.4 | 0.4 | 166 | 50 |
| 21 | 37.9 | 33.3 | 31.6 | 35.0 | 34.1 | 34.5 | 33.8 | 0.2 | 161 | 60 |
| 22 | 41.8 | 36.5 | 34.6 | 38.3 | 36.5 | 37.0 | 36.1 | 0.3 | 163 | 60 |
| 23 | 40.3 | 35.6 | 33.7 | 37.3 | 35.7 | 36.0 | 35.1 | 0.3 | 162 | 60 |
| 24 | 39.9 | 35.1 | 33.3 | 36.9 | 35.2 | 35.9 | 34.6 | 0.4 | 162 | 60 |
| 25 | 43.0 | 37.0 | 35.1 | 38.9 | 37.0 | 37.2 | 36.5 | 0.2 | 163 | 60 |
| 26 | 63.1 | 43.2 | 41.0 | 45.4 | 43.1 | 43.7 | 42.8 | 0.3 | 171 | 55 |
| 27 | 67.1 | 44.1 | 41.8 | 46.3 | 44.0 | 44.8 | 43.0 | 0.6 | 172 | 55 |
| 28 | 42.8 | 37.0 | 35.1 | 38.9 | 40.1 | 42.3 | 37.2 | 2.1 | 163 | 55 |
| 29 | 41.7 | 36.5 | 34.6 | 38.3 | 36.3 | 37.0 | 35.9 | 0.4 | 163 | 40 |
| 30 | 40.9 | 36.0 | 34.1 | 37.8 | 38.6 | 41.0 | 36.7 | 1.4 | 162 | 55 |
| 31 | 41.7 | 36.5 | 34.6 | 38.3 | 39.2 | 43.1 | 36.8 | 2.2 | 163 | 55 |
| 32 | 42.2 | 36.8 | 34.8 | 38.6 | 40.2 | 44.2 | 37.0 | 3.1 | 163 | 55 |
| 33 | 43.9 | 38.0 | 36.0 | 39.9 | 38.0 | 39.1 | 37.5 | 0.6 | 164 | 55 |
| 34 | 41.2 | 36.3 | 34.4 | 38.1 | 36.2 | 37.1 | 35.1 | 0.7 | 162 | 55 |
| 35 | 42.3 | 37.3 | 35.3 | 39.1 | 37.3 | 37.9 | 36.9 | 0.4 | 163 | 55 |
| 36 | 43.0 | 37.0 | 35.1 | 38.9 | 37.0 | 38.1 | 36.5 | 0.6 | 163 | 55 |
| 37 | 53.5 | 44.5 | 42.2 | 46.7 | 44.4 | 45.5 | 43.6 | 0.7 | 168 | 50 |

As shown in Table 7, in test Nos. 1 to 27 and Nos. 33 to 37 of Examples of the present invention, the hardness R [HRC] at the position 5 mm away from the quenching end measured through the end quenching method (Jominy method) falls, in a stable manner, within the range between H×0.948 (lower limit) and H×1.05 (upper limit) calculated from the hardness H [HRC] corresponding to 3/16 inch in the Jominy curve and calculated on the basis of the Di value, the C % and the Di method. Further, the resulting hardenability is equivalent to a hardenability in the case where the amount of Al is not increased. Yet further, the machinability (VL1000) exhibits an excellent value of more than or equal to 50 m/min.

On the other hand, in the test No. 28 of Comparative Example, the hardness R [HRC] at the position 5 mm measured from the quenching end exceeds the upper limit calculated from the H, falls outside the range, and exhibits unstable hardenability. This is because the amount of B in the inevitable impurities exceeds 0.0004 mass %, and hence, the hardenability increases.

In the test No. 29 of Comparative Example, the machinability was poor. This is because the amount of Al in the steel material for hardening is less than 0.06 mass %, and hence, the effect of improving the machinability resulting from the solute Al cannot be obtained.

In the test No. 30 of Comparative Example, the hardness R [HRC] at the position 5 mm measured from the quenching end exceeds the upper limit calculated from the H, falls outside the range, and exhibits unstable hardenability. This is because the amount of N is lower than 0.0060 mass %, and hence, a sufficient amount of BN is not generated. Thus, a large amount of the solute B that can be segregated in the austenite grain boundary remains, and the hardenability increases.

In the tests Nos. 31 and 32 of Comparative Example, the hardness R [HRC] at the position 5 mm away from the quenching end exceeds the upper limit calculated from the H, falls outside the range, and exhibits unstable hardenability. This is because no heat treatment having the condition corresponding to the heat treatment 1 was applied, and hence, MnS is not sufficiently made finer. Thus, a large amount of the solute B that can be segregated in the austenite grain boundary remains, and the hardenability increases.

INDUSTRIAL APPLICABILITY

As described above, according to the present invention, the effect of improving the machinability prolongs the tool life, thereby reducing the production cost. Further, stable hardenability is achieved, thereby suppressing variations in the deformation caused by heat treatment. Thus, the present invention is highly applicable in the steel industry.

The invention claimed is:

1. A steel material for hardening, including chemical components, by mass %, of:

C: 0.15 to 0.60%;
Si: 0.01 to 1.5%;
Mn: 0.05 to 2.5%;
P: 0.005 to 0.20%;
S: 0.001 to 0.35%;
Al: over 0.06 to 0.3%; and
total N: 0.006 to 0.03%,
with a balance including Fe and inevitable impurities including B of not more than 0.0004%, wherein
R and H satisfy following Equation (1), where the R is a hardness at a position 5 mm away from a quenching end measured through a Jominy end-quenching method specified in JIS G 0561, and the H is a calculation hardness at a position 4.763 mm away from the quenching end $$H\times0.948\leqq R\leqq H\times1.05 \quad \text{Equation (1).}$$

2. The steel material for hardening according to claim 1, wherein the chemical components further include, in mass %, one or more of:

Cr: 0.1 to 3.0%;
Mo: 0.01 to 1.5%;
Cu: 0.1 to 2.0%;
Ni: 0.1 to 5.0%;
Ca: 0.0002 to 0.005%;
Zr: 0.0003 to 0.005%;
Mg: 0.0003 to 0.005%;
REM: 0.0001 to 0.015%;
Nb: 0.01 to 0.1%;
V: 0.03 to 1.0%;
W: 0.01 to 1.0%;
Sb: 0.0005 to 0.0150%;
Sn: 0.005 to 2.0%;
Zn: 0.0005 to 0.5%;
Te: 0.0003 to 0.2%;
Bi: 0.005 to 0.5%; and
Pb: 0.005 to 0.5%.

3. The steel material for hardening according to claim 1, wherein the chemical components further include, in mass %, Ti: 0.001 to 0.05%, wherein [total N] and [Ti] satisfy following Equation (2), where [total N] is total amount (%) of N, and [Ti] is amount (%) of Ti $$0.006+[\text{Ti}]\times(14/48)\leqq[\text{total N}]\leqq0.03 \quad \text{Equation (2)}$$

4. The steel material for hardening according to claim 3, wherein the chemical components further include, in mass %, one or more of:

Cr: 0.1 to 3.0%;
Mo: 0.01 to 1.5%;
Cu: 0.1 to 2.0%;
Ni: 0.1 to 5.0%;
Ca: 0.0002 to 0.005%;
Zr: 0.0003 to 0.005%;
Mg: 0.0003 to 0.005%;
REM: 0.0001 to 0.015%;
Nb: 0.01 to 0.1%;
V: 0.03 to 1.0%;
W: 0.01 to 1.0%;
Sb: 0.0005 to 0.0150%;
Sn: 0.005 to 2.0%;
Zn: 0.0005 to 0.5%;
Te: 0.0003 to 0.2%;
Bi: 0.005 to 0.5%; and
Pb: 0.005 to 0.5%.

5. A power-transmitting part obtained by subjecting the steel material for hardening according to any one of claims 1 to 4 to a machine work and hardening.

* * * * *

UNITED STATES PATENT AND TRADEMARK OFFICE

CERTIFICATE OF CORRECTION

PATENT NO. : 8,535,459 B2
APPLICATION NO. : 13/520633
DATED : September 17, 2013
INVENTOR(S) : Kei Miyanishi et al.

It is certified that error appears in the above-identified patent and that said Letters Patent is hereby corrected as shown below:

In the Specification

Column 1, line 65, change "$[Mg]/[S] \leq 7.7 \times 10^{-3}$" to -- $[Mg]/[S] \geq 7.7 \times 10^{-3}$ --.

Signed and Sealed this
Twelfth Day of August, 2014

Michelle K. Lee

Michelle K. Lee
*Deputy Director of the United States Patent and Trademark Office*